US008624752B2

(12) United States Patent
Lanzl et al.

(10) Patent No.: US 8,624,752 B2
(45) Date of Patent: Jan. 7, 2014

(54) SAFETY MEANS FOR A CONSTRUCTION MACHINE

(75) Inventors: Martin Lanzl, Ingolstadt (DE); Josef Haas, Schrobenhausen (DE); Markus Mayr, Ehekirchen (DE); Manfred Angermeier, Karlskron (DE); Thomas Elsner, Schrobenhausen (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 311 days.

(21) Appl. No.: 13/072,460

(22) Filed: Mar. 25, 2011

(65) Prior Publication Data

US 2011/0254694 A1 Oct. 20, 2011

(30) Foreign Application Priority Data

Apr. 16, 2010 (EP) ..... 10004085

(51) Int. Cl.
*G08B 21/00* (2006.01)

(52) U.S. Cl.
USPC ..... 340/689; 340/686.2

(58) Field of Classification Search
USPC ..... 340/689, 686.2
See application file for complete search history.

(56) References Cited

U.S. PATENT DOCUMENTS

| | | | | |
|---|---|---|---|---|
| 4,368,824 | A * | 1/1983 | Thomasson | 212/278 |
| 4,511,974 | A * | 4/1985 | Nakane et al. | 701/124 |
| 6,032,094 | A * | 2/2000 | Yanagi et al. | 701/50 |
| 6,272,413 | B1 * | 8/2001 | Takahashi et al. | 701/50 |
| 6,343,799 | B1 * | 2/2002 | Moyer | 280/6.154 |
| 6,894,621 | B2 * | 5/2005 | Shaw | 340/685 |
| 2003/0060923 | A1 | 3/2003 | Scotese | |
| 2006/0289205 | A1 | 12/2006 | Law et al. | |
| 2007/0150149 | A1 * | 6/2007 | Peterson et al. | 701/50 |
| 2009/0089703 | A1 | 4/2009 | Kim et al. | |
| 2009/0143619 | A1 * | 6/2009 | Kauth et al. | 562/847 |

FOREIGN PATENT DOCUMENTS

| | | | |
|---|---|---|---|
| JP | H8-326459 | A | 12/1996 |
| JP | H10-273921 | A | 10/1998 |
| JP | 2004-308185 | A | 11/2004 |
| JP | 2010-1613 | A | 1/2010 |
| JP | 2010-138657 | A | 6/2010 |
| RU | 2245294 | C2 | 1/2005 |
| RU | 2267458 | C1 | 1/2006 |
| SU | 1159991 | A1 | 6/1985 |
| WO | 90/07465 | A1 | 7/1990 |

OTHER PUBLICATIONS

G.Garrido; European Search Report; EP10004085; Sep. 16, 2010.

* cited by examiner

*Primary Examiner* — Eric M Blount
(74) *Attorney, Agent, or Firm* — Studebaker & Brackett PC

(57) ABSTRACT

The invention relates to a safety means for a construction machine having a carrier unit and an actuation unit, which is adjustable with respect to the carrier unit, comprising at least one detecting means for detecting the current position of the actuation unit relative to the carrier unit, an indication means with which the current position of the actuation unit relative to the carrier unit can be indicated, and an evaluation unit, by means of which, depending on at least one input value, at least one adjustment range of the actuation unit can be determined, in which the actuation unit is adjustable at a given safety against tilting of the construction machine, whereby the adjustment range can be indicated together with the current position of the actuation unit by means of the indication means.

19 Claims, 3 Drawing Sheets

SAFETY MEANS FOR A CONSTRUCTION MACHINE

Figure 1:
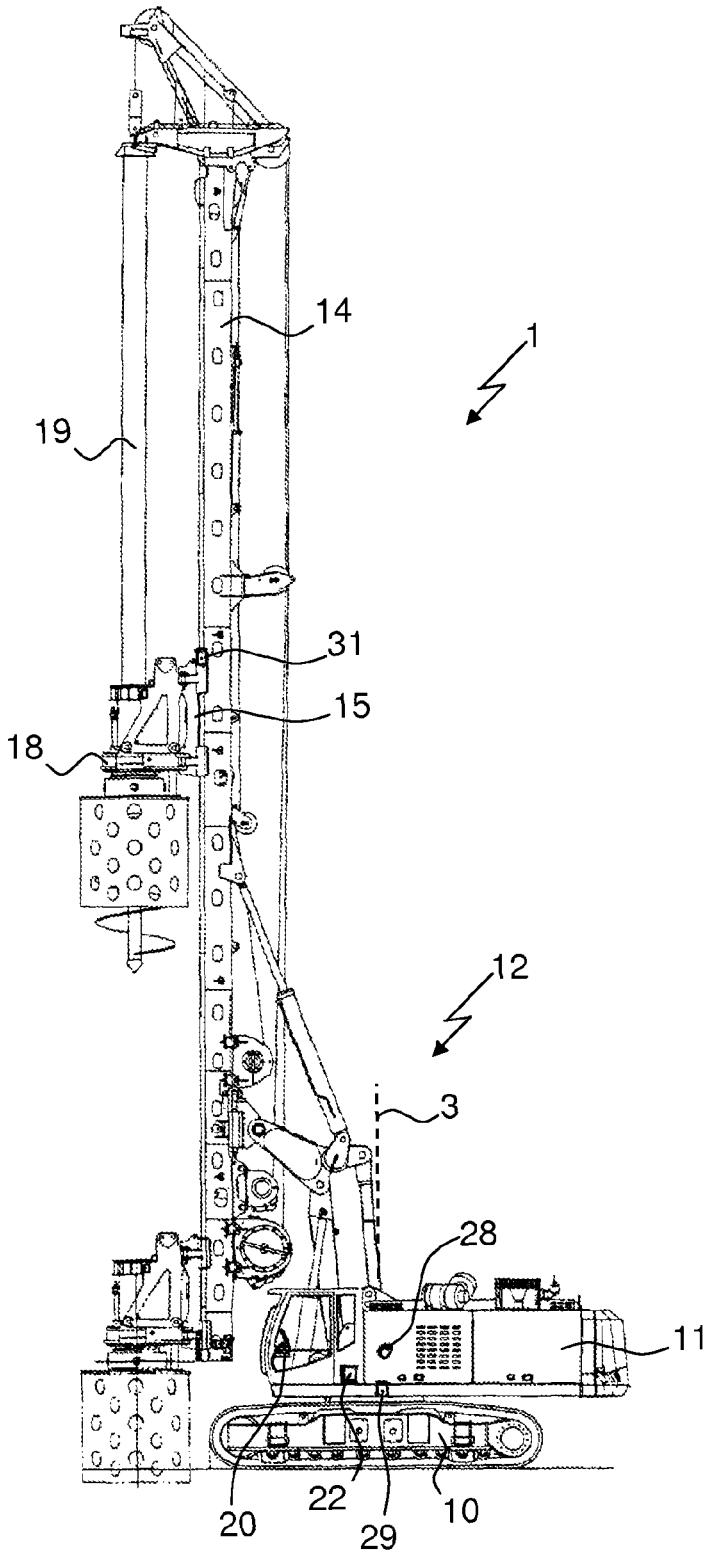

The invention relates to a safety means for a construction machine having a carrier unit and an actuation unit, which is adjustable with respect to the carrier unit, in accordance with claim 1.

During operation of large construction machines, as for example earth drilling apparatuses, tilting moments may occur on the construction machines. Such tilting moments can be caused statically, for example by projecting loads, but also dynamically, for example as a result of centrifugal forces.

In order to prevent the occurrence of excessive tilting moments, it is known, among other things, to limit the adjustment paths of projecting loads. However, in many cases this also leads to a restriction of the operating range of the construction machine and therefore to a limitation of the range of application of the construction machine.

The object of the invention is to provide a safety means for a construction machine which, whilst having an especially high operational reliability of the construction machine in particular with regard to safety against tilting, ensures an especially large working radius, an especially large versatility of application and an especially high efficiency of the construction machine.

The object is solved by a safety means having the features of claim 1. Preferred embodiments are stated in the dependent claims.

In accordance with the invention a safety means for a construction machine is provided, which has a carrier unit and an actuation unit, which is adjustable with respect to the carrier unit, comprising at least one detecting means for detecting the current position of the actuation unit relative to the carrier unit, an indication means with which the current position of the actuation unit relative to the carrier unit can be indicated, and an evaluation unit, by means of which, depending on at least one input value, at least one adjustment range of the actuation unit can be determined, in which the actuation unit is adjustable at a given safety against tilting of the construction machine, whereby the adjustment range can be indicated together with the current position of the actuation unit by means of the indication means.

The invention is based on the knowledge that during adjustment of a heavy-weight actuation unit relative to the carrier unit, which supports the actuation unit, shifts of the center of mass occur that are accompanied by corresponding variable tilting moments. In order to enable a tilt-safe operation despite these variable tilting moments an evaluation unit is provided in accordance with the invention. This evaluation unit determines an adjustment range, in which the actuation unit can be moved safely with respect to its carrier unit. The safe adjustment range can be characterized, for example, in that within it a preset tilting-safety factor is observed. To determine the adjustment range e.g. appropriate characteristic curves or charts can be stored in the evaluation unit. The determination of the adjustment range is effected through dependence on at least one input value, i.e. by comprehensive consideration the evaluation unit can take into account that the tilting tendency is not only determined by the projection of the actuation unit but is also influenced by further factors, such as the load present on the actuation unit or the dynamic state of the construction machine. Therefore, the at least one input value can be, for example, the diameter of a drill pipe held by the actuation unit, with the diameter, in turn, having an effect on the tilting moment via the related mass of the drill pipe.

Furthermore, according to the invention an indication means is provided with which both the determined safe adjustment range and the actual current adjusting position of the actuation unit are indicated to the operator collectively. In this way, the operator can see at a glance if the actuation unit is currently located at the center of the safe adjustment range, which is indicative of high safety reserves, or if operation in the border regions of the safe adjustment range is taking place, in which an increase of the projection of the actuation unit is perhaps no longer possible. Therefore, the operator can also comprehend at an early stage if additional measures are required to increase the safety against tilting, as for example the limitation of dynamic forces. As a result, a particularly efficient and at the same time safe operation is rendered possible. The invention therefore provides a visual representation of the current situation of tilting safety, which can be grasped by an operator in an especially easy and intuitive manner and thereby allows for an especially high operational reliability.

The construction machine concerned can, in particular, be an earth drilling apparatus. In this case the actuation unit can be e.g. the drill drive for the earth drilling tool and the carrier unit can be the undercarriage of the drilling apparatus.

Provision can be made, for example, that the actuation unit is pivotable relative to the carrier unit about a vertical axis, that at least one detecting means for detecting the current pivot position of the actuation unit relative to the carrier unit about the vertical axis is provided and that by means of the indication means the adjustment range can be indicated together with the current pivot position of the actuation unit. According to this embodiment the actuation unit, for instance the drill drive, is adjustable about a vertically running axis which allows for a particularly large work range of the construction machine. In this case the adjustment range relates to the pivot angle about the vertical axis and the aforementioned current position of the actuation unit comprises at least the pivot position about the vertical axis.

Furthermore, it is useful that the actuation unit is adjustable radially to the vertical axis, that at least one detecting means for detecting the current radial position of the actuation unit relative to the vertical axis is provided, and that by means of the indication means the adjustment range can be indicated together with the current radial position of the actuation unit. According to this embodiment the actuation unit is radially adjustable to a vertical axis and the safe adjustment range relates to this radial adjustment path. Consequently, the aforementioned current position includes at least the radial position of the actuation unit.

The safety means can be employed especially in a mobile construction machine because in this case particular attention must often be paid to safety against tilting. Accordingly, it is useful for the carrier unit to have a running gear.

In particular, provision can be made for the actuation unit to have at least one foundation construction tool, especially a drilling tool. The actuation unit can be designed, for example, as a rotary drill drive and/or a vibratory drill drive for such a foundation construction tool.

Basically, it would be possible to depict the adjustment range and the current position of the actuation unit on the same display but next to each other for example. However, it is especially advantageous for the indication means to be adapted to depict the adjustment range as well as the current position in one common sketch-map. Such a depiction enables the operator to visually grasp the situation of tilting safety in an especially easy way, since the current position is put in direct relation to the limits of the safe adjustment range. For best suitability, the sketch-map is indicated on a display.

With regard to the depiction of the data it can furthermore be of advantage that on change of position of the actuation unit the adjustment range is depicted in a stationary manner by the indication means. According to this embodiment, the depiction of the actuation unit moves across the display upon adjustment of the actuation unit, while the adjustment range remains stationary in the display. As a result, an especially steady picture is produced. Basically, it is also possible to keep the depiction of the actuation unit stationary in the case of change of position the actuation unit while the depiction of the adjustment range is moved. As a result, a particularly easy-to-grasp picture can be obtained.

It is particularly useful for the indication means to render a stylized plan view of at least a part of the construction machine as well as the adjustment range. In this way, a situational depiction is made available that, intuitively, is especially easy to grasp.

In accordance with the invention it can be preferred that the indication means is adapted to depict the adjustment range through colored highlighting. More particularly, the adjustment range can be indicated through colored highlighting of its area in a display. For example provision can be made for the admissible adjustment range to be indicated in the display by a green area. Alternatively or additionally it is possible to depict the limits of the adjustment range as lines in the display. The current position of the actuation unit can be depicted, for example, by a dot and/or a reticule in the display that moves on the display across the depicted adjustment range in the case of change of the current position. It is also possible to depict the current position of the actuation unit through a stylized rendering of the actuation unit in the display whereby the amount of abstraction is reduced.

Another preferred embodiment of the invention resides in the fact that by means of the evaluation unit a first adjustment range for unrestricted operation and a second adjustment range for restricted operation of the construction machine can be determined. The adjustment range for restricted operation can be understood as a range in which in order to achieve the required safety against tilting additional operating parameters, such as the loading of the actuation unit, have to be restricted, whereas in the adjustment range for unrestricted operation such restrictions of additional operating parameters are not necessary. By providing several adjustment ranges the working radius of the construction machine can be increased.

In this connection it is of advantage that the indication means is adapted to depict both adjustment ranges as well as the current position in one common sketch-map, with the adjustment ranges being preferably depicted in different colors. In particular, the adjustment range for unrestricted operation can be depicted in green and the adjustment range for restricted operation in yellow, which corresponds to the colors commonly used for different danger levels and thereby allows for an especially swift assessment of the situation by the operator.

According to the invention provision is made for the at least one adjustment range to be determined by the evaluation unit depending on at least one input value. At least one input value can be detected by sensors and constitute e.g. a value relating to the position of the construction machine or a value relating to forces that take effect on the construction machine. Alternatively or additionally provision can be made for at least one input value to be input manually. Accordingly, it is of advantage that in order to influence the adjustment range operating parameters for operation of the construction machine can be preset by an operator on the evaluation unit. For instance provision can be made for the operator to input operating parameters relating to the design of the drilling tool. Or provision can be made for the operator to preset whether a drilling operation is carried out, which is accompanied by corresponding operational forces, or whether a pure handling operation for change-over of the drilling tool is carried out.

In particular, according to the invention the input values for the evaluation unit can be detected via detecting means on the construction machine, be input manually and/or selected from a database.

The invention also relates to a construction machine having a safety means in accordance with the invention.

Figure 2:
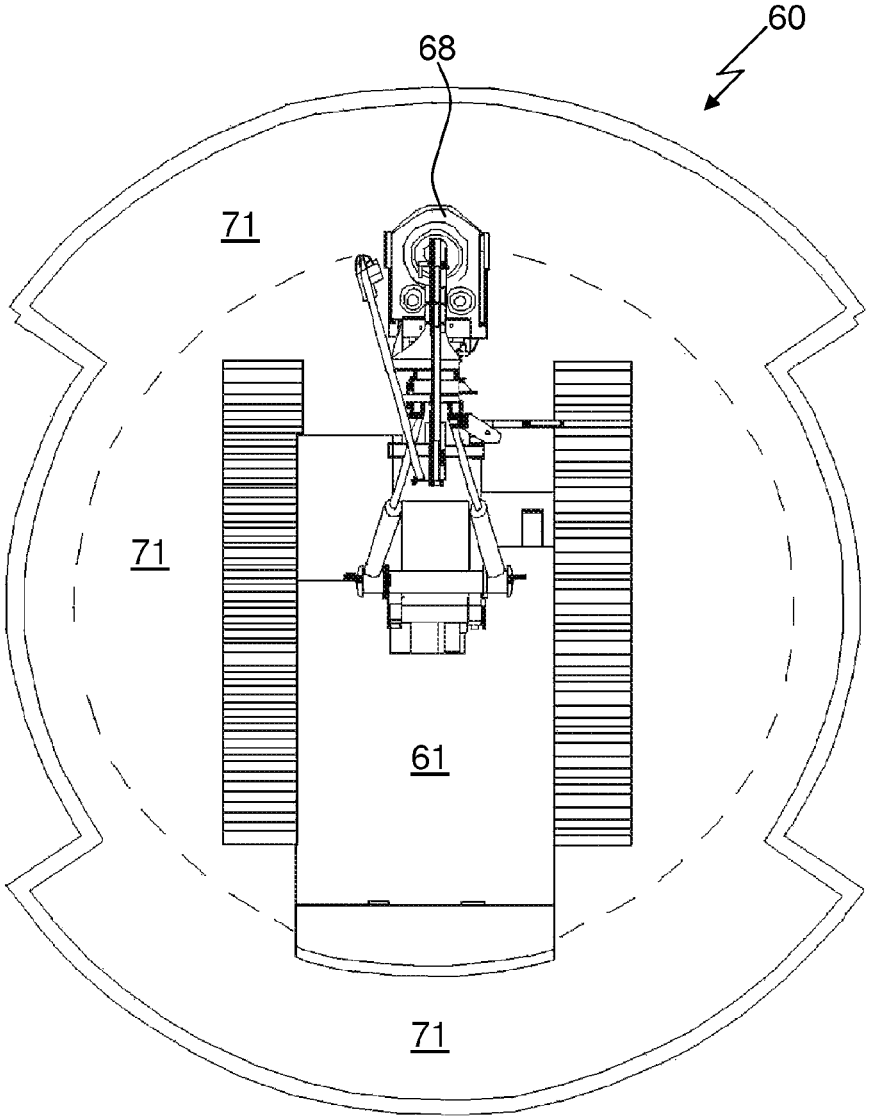
Figure 3:
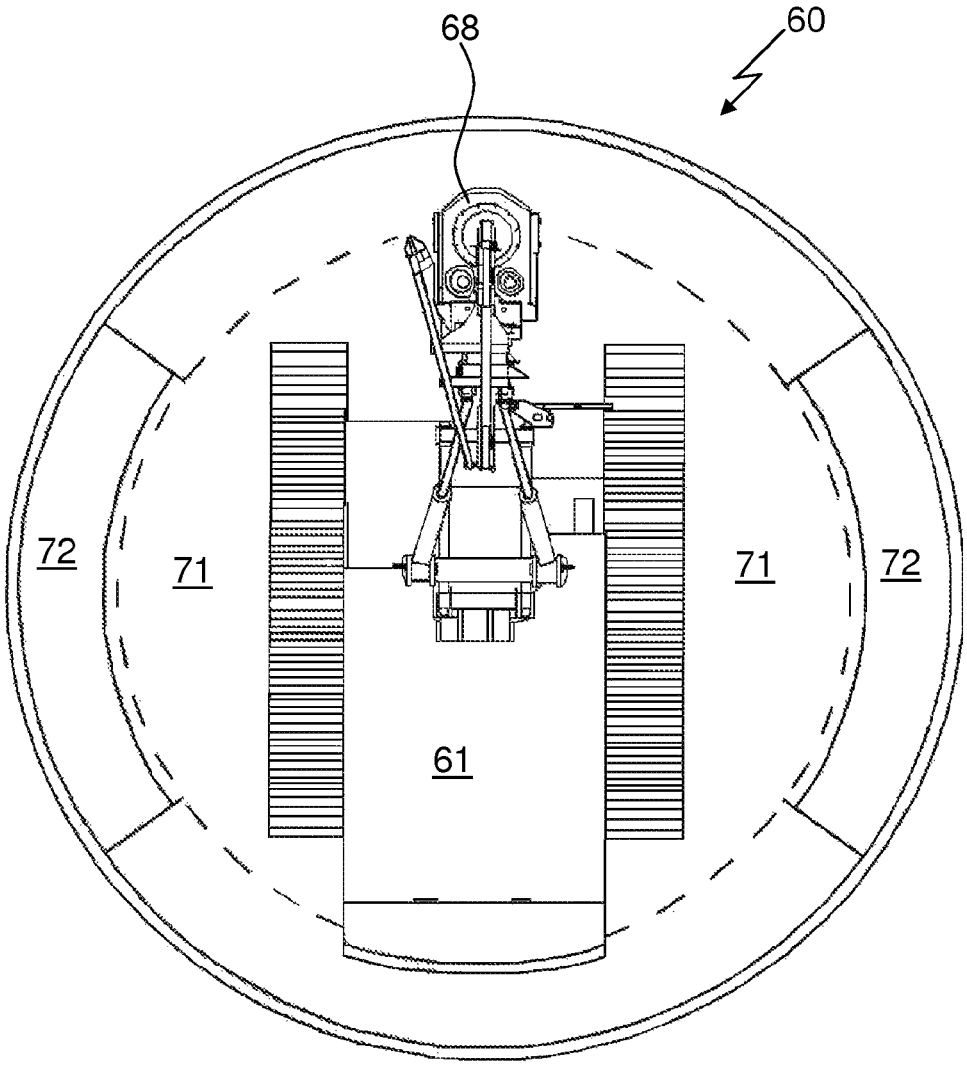

In the following the invention will be explained in greater detail by way of preferred embodiments illustrated schematically in the accompanying Figures, wherein show:

FIG. 1 a side view of a construction machine having a safety means according to the invention;

FIG. 2 a possible display depiction of a safety means according to the invention pursuant to a first embodiment; and FIG. 3 a display depiction according to a second embodiment of the invention.

A construction machine having a safety means according to the invention is shown in FIG. 1. The construction machine 1 is designed as a mobile earth drilling apparatus. It has a crawler-type running gear that constitutes a carrier unit 10. On this carrier unit 10 an upper carriage 11 of the construction machine is arranged. The upper carriage 11 is provided on the carrier unit 10 by being pivotable about the vertical axis 3. On the upper carriage 11, in turn, mast supports 12 are arranged that support a mast 14 and connect it to the upper carriage 11. The mast supports 12 are provided in a pivotable manner about horizontally running axes. By pivoting the mast supports 12 the mast 14 can be adjusted radially with respect to the upper carriage 11 and therefore the carrier unit 10. On the mast 14, in turn, a sledge 15 is arranged in a vertically displaceable manner. On this sledge 15 an actuation unit 18 is provided that constitutes a drill drive for a drill rod 19.

By pivoting the upper carriage 11 relative to the carrier unit 10 the actuation unit 18 can also be pivoted with respect to the carrier unit 10 about the vertical axis 3. By pivoting the mast supports 12 the actuation unit 18 can be pivoted radially to the carrier unit 10 in relation to the vertical axis 3.

On the upper carriage 11 a detecting means 29 for detecting the current pivot position of the upper carriage 11 and therefore of the actuation unit 18 relative to the carrier unit 10 is provided. Furthermore, on the upper carriage 11 a further detecting means 28 for detecting the current radial position of the actuation unit 18 relative to the upper carriage 11 and therefore to the carrier unit 10 is arranged. This second detecting means 28 is designed as a rotation angle detecting means for determining the pivot angle of the mast supports 12 about the horizontal pivot axis.

The safety means according to the invention has an evaluation unit 22, which is in signal connection with the detecting means 28 and 29 in order to detect the current position of the actuation unit 18. Moreover, the safety means has an indication means 20 that is arranged in the operator's cabin of the construction machine 1. The evaluation unit 22 can also be in signal connection with further detecting means on the construction machine 1 whereby, as an example of such further detecting means, a detecting means 31 for determining a pull and/or push force present during vertical feeding of the sledge 15 with respect to the mast 14 is shown in FIG. 1.

By means of the evaluation unit 22 and the indication means 20 sketch-maps are produced and indicated that visualize the tilting stability of the construction machine 1. An example of such a sketch-map 60 is shown in FIG. 2. Such a sketch-map 60 can be depicted on a display of the indication means 20 for example.

As shown in FIG. 2, the sketch-map 60 consists of a stylized plan view of the construction machine 1. It shows a stylized depiction 61 of the construction machine 1 including a stylized depiction 68 of the actuation unit 18. Underlying this depiction is a limited area 71 which represents a safe pivoting range. This area 71 can be depicted in the display in green color for example. On consulting the sketch-map 60 the operator discerns that the stylized depiction 68 of the actuation unit 18 lies within area 71, which shows the operator that a tilt-safe operation is present. If, however, the stylized depiction 68 lay outside area 71, this would be indicative of a risk of tilting.

Another example of a sketch-map 60 is shown in FIG. 3. In the embodiment of FIG. 3 two adjustment ranges are defined, namely a first adjustment range for unrestricted operation and a second adjustment range for restricted operation. In the restricted operating mode additional restrictions may be necessary, for instance a restriction of the winch pulling forces of a main winch, an auxiliary winch and/or a feed winch.

The first adjustment range is represented in the sketch-map 60 by area 71, the second adjustment range by area 72. In this, the area 71 can be depicted in green for example and the area 72 in orange for example. Depending on whether the stylized depiction 68 of the actuation unit 18 lies in the range of area 71 or in the range of area 72 the operator knows whether an unrestricted or restricted operation is possible.

In order to make the operator aware of the fact that the second, restricted adjustment range is reached provision can also be made for a corresponding notification window to be issued by the indication means 20 on reaching the second range, in which case an information window with the admissible pull forces can also be inserted. In particular, the insertion can be effected on the same display that also shows the sketch-map 60.

The invention claimed is:

1. Safety means for a construction machine having a carrier unit and an actuation unit, which is adjustable with respect to the carrier unit, comprising at least one detecting means for detecting the current position of the actuation unit relative to the carrier unit, an indication means with which the current position of the actuation unit relative to the carrier unit can be indicated, and an evaluation unit, by means of which, depending on at least one input value, at least one adjustment range of the actuation unit can be determined, in which the actuation unit is adjustable at a given safety against tilting of the construction machine, whereby the adjustment range can be indicated together with the current position of the actuation unit by means of the indication means, and the indication means is adapted to depict the adjustment range as well as the current position of the actuation unit in one common sketch-map.

2. Safety means according to claim 1, wherein the actuation unit is pivotable relative to the carrier unit about a vertical axis, at least one detecting means for detecting the current pivot position of the actuation unit relative to the carrier unit about the vertical axis is provided, and by means of the indication means the adjustment range can be indicated together with the current pivot position of the actuation unit.

3. Safety means according to claim 2, wherein the actuation unit is adjustable radially to the vertical axis, at least one detecting means for detecting the current radial position of the actuation unit relative to the vertical axis is provided, and by means of the indication means the adjustment range can be indicated together with the current radial position of the actuation unit.

4. Safety means according to claim 1, wherein the carrier unit is a running gear and the actuation unit has at least one foundation construction tool, in particular a drilling tool.

5. Safety means according to claim 1, wherein on change of position of the actuation unit the adjustment range is depicted in a stationary manner by the indication means.

6. Safety means according to claim 1, wherein the indication means renders a stylized plan view of at least a part of the construction machine as well as the adjustment range.

7. Safety means according to claim 1, wherein the indication means is adapted to depict the adjustment range though colored highlighting.

8. Safety means according to claim 1, wherein by means of the evaluation unit a first adjustment range for unrestricted operation and a second adjustment range for restricted operation of the construction machine can be determined, and the indication means is adapted to depict both adjustment ranges as well as the current position in one common sketch-map, with both adjustment ranges being depicted in different colors.

9. Safety means according to claim 1, wherein in order to influence the adjustment range operating parameters for operation of the construction machine can be preset by an operator on the evaluation unit.

10. Safety means according to claim 1, wherein the input values for the evaluation unit can be detected via detecting means on the construction machine, be input manually and/or selected from a database.

11. Construction machine having a safety means according to claim 1.

12. Safety means for a construction machine having a carrier unit and an actuation unit, which is adjustable with respect to the carrier unit, comprising at least one detecting means for detecting the current position of the actuation unit relative to the carrier unit, an indication means with which the current position of the actuation unit relative to the carrier unit can be indicated, and an evaluation unit, by means of which, depending on at least one input value, at least one adjustment range of the actuation unit can be determined, in which the actuation unit is adjustable at a given safety against tilting of the construction machine, whereby the carrier unit is a running gear and the actuation unit has at least one foundation construction tool, in particular a drilling tool.

13. Safety means according to claim 12, wherein the actuation unit is pivotable relative to the carrier unit about a vertical axis, at least one detecting means for detecting the current pivot position of the actuation unit relative to the carrier unit about the vertical axis is provided, and by means of the indication means the adjustment range can be indicated together with the current pivot position of the actuation unit.

14. Safety means according to claim 13, wherein the actuation unit is adjustable radially to the vertical axis, at least one detecting means for detecting the current radial position of the actuation unit relative to the vertical axis is provided, and by means of the indication means the adjustment range can be indicated together with the current radial position of the actuation unit.

15. Construction machine having a safety means according to claim 12.

16. Safety means for a construction machine having a carrier unit and an actuation unit, which is adjustable with respect to the carrier unit, comprising at least one detecting means for detecting the current position of the actuation unit relative to the carrier unit, an indication means with which the current position of the actuation unit relative to the carrier unit can be indicated, and an evaluation unit, by means of which, depending on at least one input value, at least one adjustment range of the actuation unit can be determined, in which the actuation unit is adjustable at a given safety against tilting of the construction machine, whereby on change of position of the actuation unit the adjustment range is depicted in a stationary manner by the indication means.

17. Safety means according to claim 16, wherein the actuation unit is pivotable relative to the carrier unit about a vertical axis, at least one detecting means for detecting the current pivot position of the actuation unit relative to the carrier unit about the vertical axis is provided, and by means of the indication means the adjustment range can be indicated together with the current pivot position of the actuation unit.

18. Safety means according to claim 17, wherein the actuation unit is adjustable radially to the vertical axis, at least one detecting means for detecting the current radial position of the actuation unit relative to the vertical axis is provided, and by means of the indication means the adjustment range can be indicated together with the current radial position of the actuation unit.

19. Construction machine having a safety means according to claim 16.

* * * * *